United States Patent [19]

McEwen

[11] 4,163,497

[45] Aug. 7, 1979

[54] PHARMACIST'S PRESCRIPTION FILE HOLDER

[76] Inventor: William D. McEwen, 727 Viewcrest Dr., Ventura, Calif. 93003

[21] Appl. No.: 904,326

[22] Filed: May 9, 1978

[51] Int. Cl.[2] ..... B42F 17/12

[52] U.S. Cl. ..... 211/11; 211/184; 248/441 R; 248/460

[58] Field of Search ..... 211/11, 55, 50, 184, 211/42, 43; 248/220.2, 441 R, 460

[56] References Cited

U.S. PATENT DOCUMENTS

| | | | |
|---|---|---|---|
| 674,668 | 5/1901 | Bisler | 248/441 R |
| 867,599 | 10/1907 | Rand | 211/11 |
| 1,415,110 | 5/1922 | Pearl | 211/11 |
| 2,383,287 | 8/1945 | Berg | 248/460 |
| 3,557,965 | 1/1971 | Angerholm | 211/11 |

FOREIGN PATENT DOCUMENTS

| | | | |
|---|---|---|---|
| 338287 | 6/1959 | Switzerland | 211/42 |

*Primary Examiner*—Roy D. Frazier
*Assistant Examiner*—William E. Lyddane
*Attorney, Agent, or Firm*—Ralph B. Pastoriza

[57] ABSTRACT

The file holder includes an elongated board with a plurality of transverse grooves cut in its top surface. A plurality of racks of L-shape in cross section include downwardly extending stems receivable in the grooves to support the racks in inclined positions on the board. The spacing of the grooves and inclination of the racks is such that identifying information constituting the top few lines on pharmacist's prescription files placed in the racks is clearly visible to a pharmacist at all times so that a desired prescription file can readily be located when stored in the holder.

5 Claims, 5 Drawing Figures

PHARMACIST'S PRESCRIPTION FILE HOLDER

This invention relates generally to holding racks and more particularly to a pharmacist's prescription file holder for use on pharmacy counters in drugstores, pharmaceutical houses and the like.

BACKGROUND OF THE INVENTION

At the present time, there exists a problem in most pharmacies having to do with the organization of prescription files for various patients. While such files may, of course, be stored in a conventional file index, it is always a time consuming operation for the pharmacist to open the file drawer, locate the file, pull the file and examine the same to determine the patient, name of the doctor and number of the prescription. The file must then be replaced in the file drawer if such is used.

Since normally the only pertinent information required in most pharmaceutical operations once a patient file has been established is the name of the patient, doctor and prescription number, the prescription files themselves are oftentimes simply stacked so that rather than go to an index file drawer, the pharmacist can quickly shuffle through the various files in attempting to locate a particular prescription for a particular patient. While this latter procedure may save some time, the mere presence of stacks of prescription files on a prescription counter is not only unsightly but the stacks tend to get scattered and there is danger of losing one or more of the files. Moreover, it still requires time on the part of the pharmacist to shuffle through and find the correct file.

BRIEF DESCRIPTION OF THE PRESENT INVENTION

With the foregoing considerations in mind, the present invention contemplates a specifically designed prescription file holder for use by pharmacists in overcoming the above-noted problems.

More particularly, this invention contemplates the provision of a prescription file holder in the form of an elongated board having a plurality of transverse grooves cut into its top surface. A plurality of racks of L-shape in cross section in turn are provided with downwardly extending stems receivable in the grooves to support the racks in inclined positions on the board.

With the foregoing arrangement, identifying information constituting the top few lines on prescription files; for example, the name of the patient, doctor and the prescription number, placed in the racks is clearly visible to the pharmacist at all times so that a desired prescription file can readily be located when stored in the holder.

The overall length of the holder itself corresponds to the width of the prescription counter so that it can be nicely received on the counter for holding the prescription files in an organized manner.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
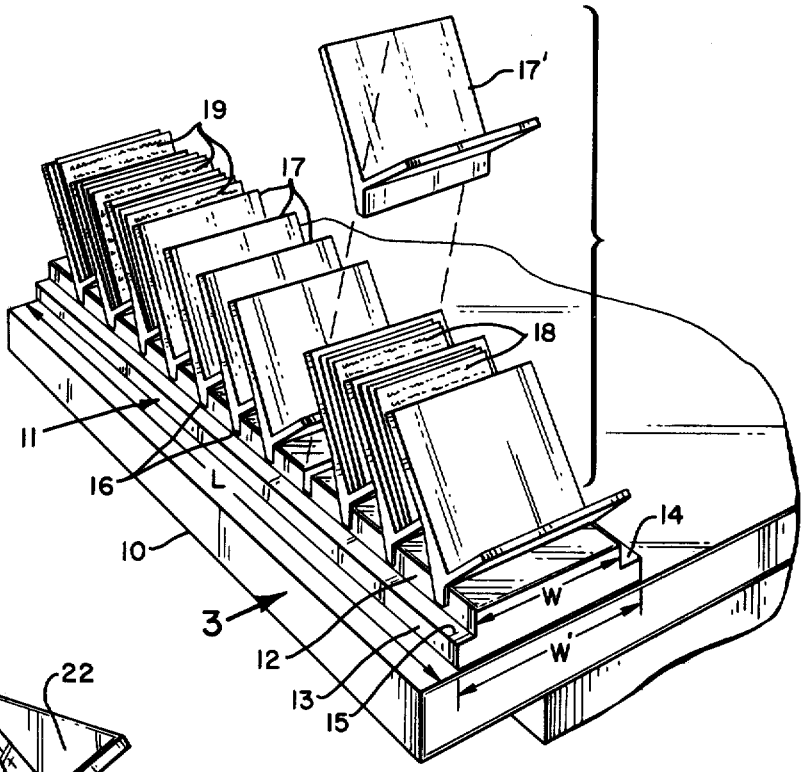
FIG. 1 is a perspective view of the prescription file holder of this invention positioned on a prescription counter.

Referring first to FIG. 1, there is shown a portion of a prescription counter 10 upon which the holder of this invention designated generally by the numeral 11 has been positioned. This holder includes an elongated board having an upper portion 12 of given width W and length L and an integral base portion 13 of the same length L as the upper portion but of greater width as indicated at W' to define longitudinal steps 14 and 15 on either longitudinal side of the board.

A plurality of evenly spaced transverse grooves 16 are formed on the upper portion 12, these grooves running from one longitudinal edge of the upper portion to the other. Supported in these grooves are shown a plurality of inclined racks 17 for holding various prescription files 18. The spacing between successive grooves 16 and the angle of inclination of the racks from the horizontal are such that identifying information constituting the top few lines on the prescription files such as indicated at 19 in FIG. 1 is clearly visible to a pharmacist at all times so that a desired prescription file can readily be located when stored in the holder. Thus, the first few lines 19 on the prescription file 18 would include the name of the patient, the doctor and the prescription number. Since the holder is designed so that this information is always visible, it is not even necessary for a pharmacist to remove a prescription file from the rack in which it is stored but he need simply glance at the holder and locate quickly the prescription information desired.

Figure 2:
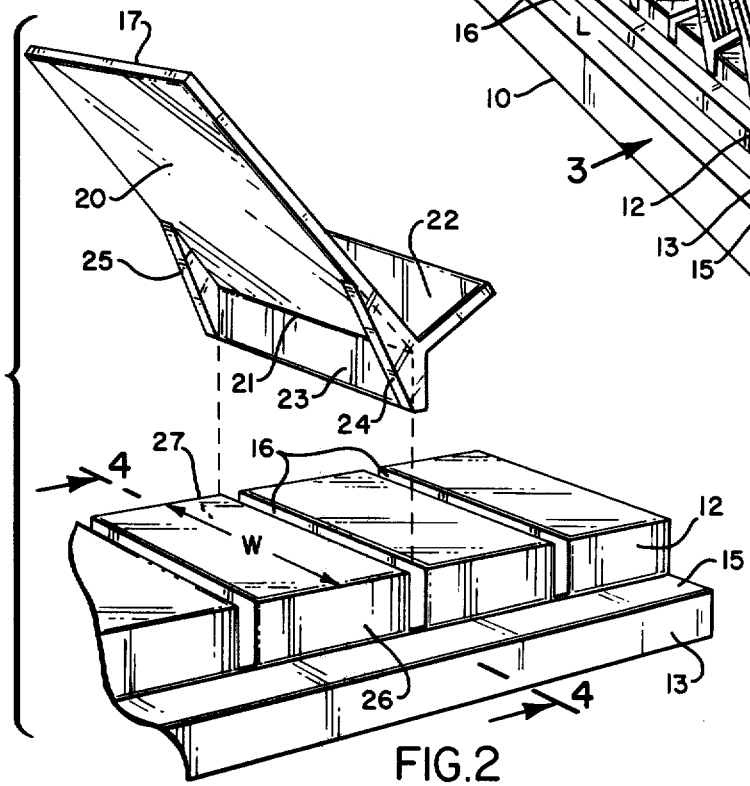
FIG. 2 is a fragmentary exploded view illustrating in greater detail components making up the holder.

Referring now to FIG. 2, further details of the holder structure will become evident. In FIG. 2 as well as the remaining figures, the same identifying numerals utilized in FIG. 1 have been used to designate the corresponding parts.

The plurality of racks 17 are all identical in construction and thus a detailed description of one will suffice for all. Thus, referring to the rack 17 shown exploded above a fragmentary portion of the board in FIG. 2, the structure includes a flat rectangular member 20 disposed in an inclined plane. The lower portion of this flat member terminates at its lower edge 21 in a ledge 22 extending normally from the plane of inclination a distance less than the length of the flat member 20 to define an L-shape in cross section as described earlier. A straight stem 23 integrally extends downwardly from the lower edge 21 at the vertex of the L-shape as shown.

The structure is completed by the provision of triangular flanges 24 and 25 integrally connecting the outer edges of the stem 23 with the lower side edge portions of the flat rectangular member 20. The distance between the opposed inside surfaces of the rectangular flanges 24 and 25 corrresponds to the given width W of the upper portion 12 of the board. Similarly, the downward extending distance and thickness of the stem 23 corresponds to the depth and width of the transverse grooves 16 such that the stem can be received in any one of the grooves to support the rectangular member in its inclined position, the flanges overlapping side surfaces of the upper portion of the board to lock the rack against lateral movement.

Figure 3:
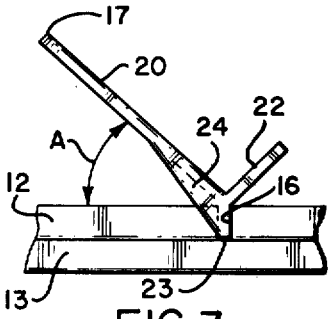
FIG. 3 is a fragmentary side view of a portion of the holder looking in the direction of the arrow 3 of FIG. 1.

Referring to FIG. 3, the rack 17 is shown with the stem portion 23 disposed within the groove 16 and it will be noted that the rectangular member 20 is inclined with respect to the horizontal at a given angle A. This angle in the preferred embodiment is 40°. It will also be noted in FIG. 3 the manner in which the flange 24 overlaps the edge surfaces of the upper portion 12 of the board.

Figure 4:
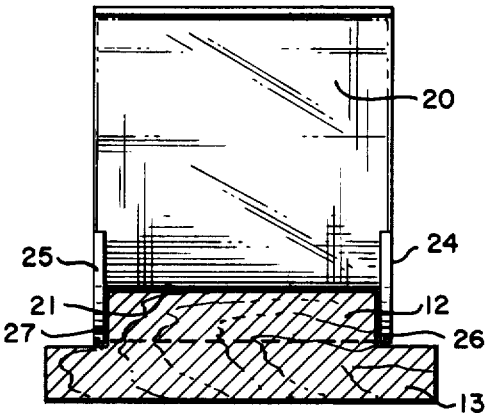
FIG. 4 is a cross section of an assembled holder looking in the direction of the arrows 4—4 of FIG. 2; and, FIG. 5 is a perspective view of a plurality of the prescription file holders in side-by-side relationship with several of the rack portions of the holder removed to avoid obscuring portions of the drawing.

In the rear sectional view of FIG. 4, this overlapping feature of the flanges 24 and 25 is clearly visible, the overlapped edge surfaces of the upper portion 12 being designated 26 and 27. It will be clear that these flanges will lock the rack against lateral movement within the slot.

As mentioned heretofore, the spacing between the successive grooves and the angle A of inclination from the horizontal of the rectangular member parts of the racks are such that identifying information on the prescription files placed in the racks is clearly visible as will be evident from a reinspection of FIG. 1. In this respect, the dimensioning of the flat rectangular member 20; that is, the inclined portion of the L-shape, is made to correspond to the dimensions of the typical prescription file so that essentially the entire supporting surface of the member 20 will be covered by the file without overlapping of the edges of the support. This dimensioning assures optimum viewing of information on the files.

Figure 5:
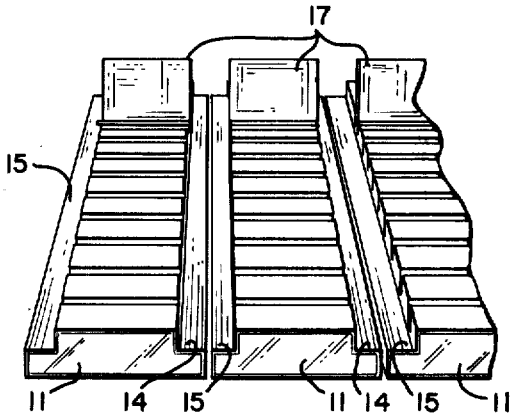

Referring now to FIG. 5, the significance of the steps 14 and 15 defined by the increased width dimension of the base portion 13 of the board will be evident. Thus, when a plurality of the boards 11 are placed in side-by-side relationship, the steps 14 and 15 will space the upper portions of the boards so that racks 17 holding prescription files on the side-by-side boards can be easily removed and replaced without interference with the racks on adjacent boards.

In the preferred embodiment, the rack 17 itself as described in detail in FIG. 2 constitutes an integral molded plastic composition. The board made up of the upper and base portions 12 and 13, in turn, is wood which may be properly varnished and finished to provide an attractive appearance. Alternatively, however, the board structure could also be of plastic material.

It will be appreciated that the racks are easily removable and replaceable and as the number of prescription files builds up, further racks can be added to any one or more of the boards until all of the grooves are essentially filled. Moreover, in the event any one patient has more than one file or a relatively thick file, it is an easy matter to simply remove one of the racks such as indicated at 17′ in FIG. 1 to thereby double the available space for accommodating files. In this respect, the spacing between successive grooves 16 relative to the dimention of the ledge portion of the L shape is such that any one individual rack can be lifted out without disturbing the others ahead of and behind the removed rack.

In actual use, the prescription file holder of this invention has been highly successful and greatly reduced the pharmacist's time in properly locating patient prescriptions. The advantages of the holder of this invention will be readily apparent. No longer must a pharmacist shuffle through stacks of loosely laid prescription files on a disorganized prescription counter.

I claim:

1. A pharmacist's prescription file holder comprising, in combination:

(a) an elongated board having a plurality of transverse grooves cut into its top surface; and (b) a plurality of racks of L-shape in cross section with downwardly extending stems receivable in said grooves to support the racks in inclined positions on said board, each of said racks including side flanges integrally extending between the outer edges of the stem and lower side edges of the inclined portion of the rack, said flanges overlapping side edges of said board when said stem is received in a groove to lock the rack against lateral movement, whereby identifying information constituting the top few lines on prescription files placed in said racks is clearly visible to a pharmacist at all times so that a desired prescription file can readily be located when stored in said holder.

2. A holder according to claim 1, in which said board has an increased width base extending laterally beyond the ends of the grooves so that when several such boards are placed in side-by-side relationship, racks in the grooves are laterally spaced from each other to facilitate placement and removal of prescription files in the racks.

3. A pharmacist's prescription file holder comprising, in combination:

(a) an elongated board having an upper portion of given width and length and an integral base portion of the same length as the upper portion but greater width to define longitudinal steps on either longitudinal side of the board;

(b) a plurality of evenly spaced transverse grooves formed in said upper portion running from one longitudinal edge of said upper portion to the other; and (c) a plurality of identically formed racks, each rack comprising:

(1) a flat rectangular member disposed in an inclined plane terminating at its lower edge in a ledge extending normally from said plane a distance less than the length of the flat member to define an L shape in cross section, (2) a straight stem integrally extending downwardly from said lower edge at the vertex of said L-shape, and (3) triangular flanges integrally connecting the outer edges of the stem with lower side edge portions of said flat rectangular member, the distance between the opposed inside surfaces of said flanges corresponding to said given width of said upper portion of said board and the downwardly extending distance and thickness of said stem corresponding to the depth and width of said transverse grooves such that said stem can be received in any one of said grooves to support said rectangular member in its inclined position, said flanges overlapping side surfaces of said upper portion of said board to lock said rack against lateral movement, whereby any number of racks up to the total number of grooves can be supported in said grooves, the spacing between successive grooves and the angle of inclination from the horizontal of the rectangular member parts of the racks being such that identifying information constituting the top first few lines on prescription files placed in said racks is clearly visible to a pharmacist at all times so that a desired prescription file can readily be located when stored in said holder.

4. A holder according to claim 3, in which said grooves constitute vertical cuts in said upper portion, said stem of each rack extending vertically downwardly from the vertex of said L-shape, said angle of inclination being 40°, and in which said longitudinal steps on either longitudinal side of said board serve to space the upper portions of a plurality of such boards when the base portions are placed in side-by-side relationship so that prescription files in said racks can easily be removed without interference from racks on an adjacent board, the dimensioning of the flat rectangular inclined members of the racks corresponding to the dimensions of prescription files placed thereon.

5. A holder according to claim 3, in which the spacing between successive grooves and the dimension of the ledge portion of the L shape of each rack is such that any one rack can be removed to leave double the space between the rack ahead of and behind the removed rack to accommodate additional files belonging to one patient.

* * * * *